US010679761B2

(12) United States Patent
Farmer et al.

(10) Patent No.: US 10,679,761 B2
(45) Date of Patent: Jun. 9, 2020

(54) CONTAINERS AND REFRACTORY METAL COATING THEREFORE FOR CONTAINING RADIOACTIVE MATERIALS

(71) Applicant: Lawrence Livermore National Security, LLC, Livermore, CA (US)

(72) Inventors: Joseph C. Farmer, Tracy, CA (US); Jor-Shan Choi, El Cerrito, CA (US); Alexander M. Rubenchik, Livermore, CA (US)

(73) Assignee: Lawerence Livermore National Security, LLC, Livermore, CA (US)

( * ) Notice: Subject to any disclaimer, the term of this patent is extended or adjusted under 35 U.S.C. 154(b) by 1359 days.

(21) Appl. No.: 14/213,120

(22) Filed: Mar. 14, 2014

(65) Prior Publication Data

US 2020/0152343 A1 May 14, 2020

Related U.S. Application Data

(60) Provisional application No. 61/783,455, filed on Mar. 14, 2013.

(51) Int. Cl.

| | |
|---|---|
| ***G21F 1/00*** | (2006.01) |
| *B05C 9/00* | (2006.01) |
| *C23C 4/00* | (2016.01) |
| *G21F 5/00* | (2006.01) |
| *C23C 24/00* | (2006.01) |
| *G21C 3/00* | (2006.01) |

(52) U.S. Cl.

CPC ..... *G21F 1/00* (2013.01); *B05C 9/00* (2013.01); *C23C 4/00* (2013.01); *C23C 24/00* (2013.01); *G21C 3/00* (2013.01); *G21F 5/00* (2013.01)

(58) Field of Classification Search

CPC ..... G21C 19/34; G21C 19/07; G21C 3/04; G21C 3/042; G21C 3/32; G21C 3/34; G21C 3/334

USPC ..... 376/272; 427/180

See application file for complete search history.

(56) References Cited

U.S. PATENT DOCUMENTS

| | | | | |
|---|---|---|---|---|
| 5,058,269 | A * | 10/1991 | May | B21C 37/155 29/897.3 |
| 5,313,506 | A * | 5/1994 | Matzner | G21C 3/344 376/260 |
| 6,379,465 | B1 * | 4/2002 | Perkins | B05B 5/00 118/308 |
| 8,187,720 | B2 | 5/2012 | Choi et al. | |
| 2003/0228415 | A1 * | 12/2003 | Bi | C23C 16/402 427/180 |
| 2007/0153965 | A1 * | 7/2007 | Choi | C23C 4/06 376/417 |
| 2011/0070795 | A1 * | 3/2011 | Prudhomme | B32B 25/20 442/136 |

(Continued)

OTHER PUBLICATIONS

"High Performance Coating of Steel with Tantalum Boride Layers" in Kerridge et al., "Refraclory Metals in Molten Salts, Nato ASI Series 3, High Technology—vol. 53", p. 17-29, @1998 Kluwer Academic Publishers.*

*Primary Examiner* — Lily C Garner

(74) *Attorney, Agent, or Firm* — Eddie E. Scott

(57) ABSTRACT

Fabricating structural components for a spent nuclear fuel container using the steps of forming cylindrical or rectangular channels to produce a structural component for a spent nuclear fuel container and applying a coating that includes tantalum-based material to the cylindrical or rectangular channels.

8 Claims, 12 Drawing Sheets

(56) References Cited

U.S. PATENT DOCUMENTS

2013/0025325 A1* 1/2013 Piwczyk ..... H01L 21/67115
65/392

* cited by examiner

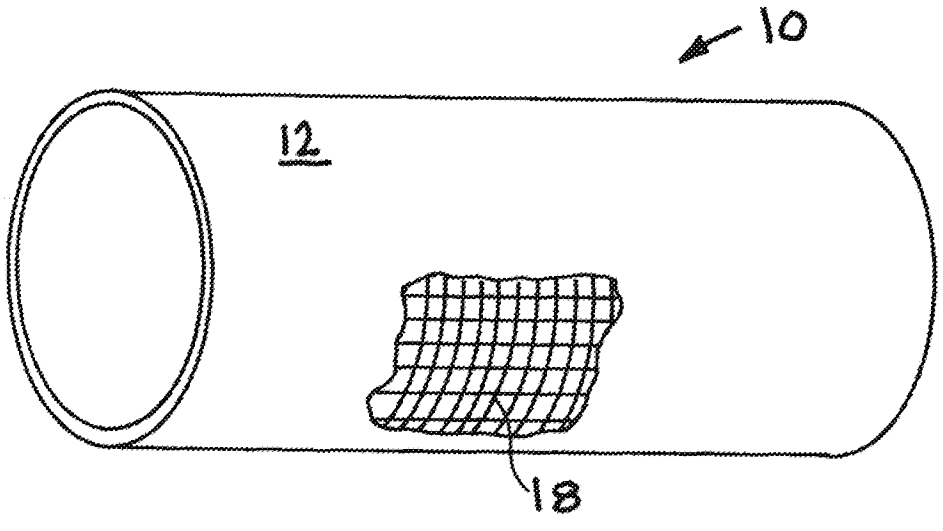
FIG. 1
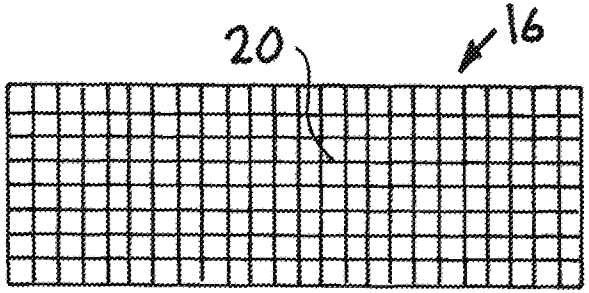
FIG. 2
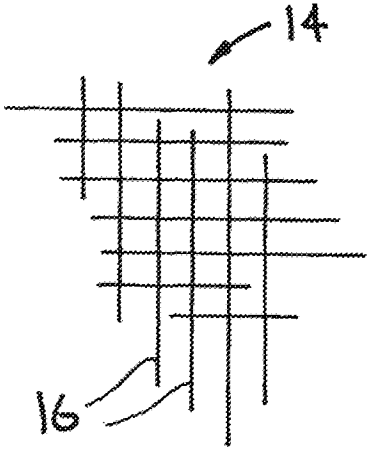

CONTAINERS AND REFRACTORY METAL COATING THEREFORE FOR CONTAINING RADIOACTIVE MATERIALS

CROSS-REFERENCE TO RELATED APPLICATIONS

This application claims benefit under 35 U.S.C. § 119(e) of U.S. Provisional Patent Application No. 61/783,455 filed Mar. 14, 2013 entitled "containers and refractory metal coating therefore for containing radioactive materials," the disclosure of which is hereby incorporated by reference in its entirety for all purposes.

STATEMENT AS TO RIGHTS TO APPLICATIONS MADE UNDER FEDERALLY SPONSORED RESEARCH AND DEVELOPMENT

The United States Government has rights in this application pursuant to Contract No. DE-AC52-07NA27344 between the United States Department of Energy and Lawrence Livermore National Security, LLC for the operation of Lawrence Livermore National Laboratory.

BACKGROUND

Field of Endeavor

The present disclosure relates to coatings for metallic structures that provide enhanced corrosion resistance, and more particularly to coatings providing ultra-high corrosion resistance and/or neutron absorbing capabilities that are well suited for use as coatings on structural components of spent nuclear fuel containers and other structural elements that may be exposed to highly corrosive and/or neutron generating substances.

State of Technology

This section provides background information related to the present disclosure which is not necessarily prior art.

Construction of containers for the safe storage and/or disposal of spent nuclear fuel from the world's nuclear reactors requires that the containers be constructed from strong, extremely corrosion-resistant and neutron-absorbing materials to ensure against accidental criticality (i.e., accidental fission chain reaction) should the fissile material of the spent nuclear fuel components come in contact with other hydrogenous material. Such containers may end up being stored at nuclear power facilities or at remote locations. Presently, spent nuclear fuel containers and/or the basket assemblies contained therein are typically constructed from stainless steel. The stainless steel may also have some quantity of nickel as well for enhanced corrosion resistance. However, it will be appreciated that nickel is expensive and the greater the concentration of nickel added, the greater the cost of the container.

The need for highly, corrosion resistant containers also extends to being able to securely contain spent nuclear fuel while the container is being transported, such as on a railroad car or flatbed truck.

In view of the increasing need and interest in safely storing high level radioactive materials, and particularly spent nuclear fuel rods, the development of highly robust, reliable, yet cost effective containers is of high importance.

SUMMARY

Features and advantages of the disclosed apparatus, systems, and methods will become apparent from the following description. Applicant is providing this description, which includes drawings and examples of specific embodiments, to give a broad representation of the apparatus, systems, and methods. Various changes and modifications within the spirit and scope of the application will become apparent to those skilled in the art from this description and by practice of the apparatus, systems, and methods. The scope of the apparatus, systems, and methods is not intended to be limited to the particular forms disclosed and the application covers all modifications, equivalents, and alternatives falling within the spirit and scope of the apparatus, systems, and methods as defined by the claims.

This section provides a general summary of the disclosure, and is not a comprehensive disclosure of its full scope or all of its features.

The present disclosure relates to coatings that may be applied to components of spent nuclear fuel containers or any other structure where ultra-high corrosion resistance and/or the need to provide neutron absorbing capabilities is desired to be imparted to an underlying structure. In one aspect the present disclosure relates to a tantalum-based material that is applied via at least one of: a spray process; a high-velocity oxy fuel (HVOF) process; a high-velocity laser-accelerated deposition (HVLD) process; an explosive bonding process; an electroplating process; a powder coating process; or any other form of spray/deposition/bonding process. In one embodiment the coating may be formed with a metallic binder phase from tantalum-based materials, such as tantalum-based powders. In another embodiment the coating may be formed with both a metallic binder phase from tantalum-based materials, and with a neutron absorbing phase. The neutron absorbing phase may be formed from one or more of a plurality of natural and B-10 enriched boron-containing materials. The neutron absorbing phase may be incorporated for a coating that is intended to be used on a basket assembly (i.e., also known as a "criticality control assembly") of a spent nuclear fuel container, or on any other structural component where neutron absorbing capability is desired.

In one or more aspects the present disclosure may involve one or more of the following materials and/or processes in forming the coatings:

1. Use of coated cylindrical and rectangular channels as the structural members of criticality control assemblies.

2. The coating of channels with corrosion-resistant neutron-absorbing materials either before or after forming flat plates into cylindrical and rectangular channels. Flat plates can be coated, and then bent or rolled into the structural members of criticality control assemblies.

3. The use of either thermal or cold spray technology to deposit such coatings on channel materials serving as structural members.

4. The materials that can be used as structural material include a wide variety of iron-based, nickel-based, aluminum-based and titanium-based materials and alloys. For example, iron-based alloys include but are not limited to Type 304 and Type 316 stainless steels; nickel-based alloys including but not limited to the entire range of Ni—Cr—Mo alloys, such as Alloy 600, Alloy 625, Alloy 825, Hastelloy C, Hastelloy C-4, Hastelloy C-276, Hastelloy C-22, and others; titanium alloys including but not limited to Ti Grade 2, Ti Grade 7, Ti Grade 12, and others; and various aluminum alloys, including but not limited to aluminum 5083 and others.

5. The use of tantalum-based materials for coating the structural members, using either a thermal spray approach, such as the cold-spray process; the high-velocity oxy fuel (HVOF) process; the high-velocity laser-accelerated deposition (HVLAD) process; explosive bonding; electroplating; powder coating; and any other technique capable of producing a composite coating.

6. In the case of tantalum-based cold-spray and thermal spray coatings, a metallic binder phase may be formed from powders of: unalloyed tantalum (Ta); unalloyed tungsten (W); unalloyed niobium (Nb); tantalum 2.5% tungsten (Ta-2.5W); tantalum 10.0% tungsten (Ta-10W); tantalum 8.0% tungsten 2.0% hafnium (Ta-111 or Ta-8W-2Hf); special niobium alloys such as Nb-1Zr; special molybdenum alloys such as TZM (Mo-0.5Ti-0.08Zr-0.03C); and others.

In the embodiment where the coating forms a tantalum-based cold-spray coating or thermal spray coating, the neutron absorbing phase may be formed from a wide variety of natural and B10-enriched boron-containing materials including but not limited to: boron carbide (B4C); tantalum diboride (TaB2); hafnium diboride (HfB2), zirconium diboride (ZrB2), and iron-based boron-containing amorphous metal powders, such as SAM2X5, SAM1651, and other such compositions. The borides may be formed in situ from a precursor phase containing boron, and co-deposited with the metallic binder phase, through special heat treatments which cause the reaction of the boron and metallic binder phase.

In the case where the coating forms an amorphous-metal cold-spray and thermal spray coatings, any corrosion-resistant iron-based boron-containing alloy can be used, including but not limited to SAM2X1, SAM2X3, SAM2X5, SAM2X7, SAM1651, and others.

The metallic binder and neutron absorbing phases can also be deposited by electrodeposition, electrophoretic deposition, powder coating, and other methods.

The coating of the present disclosure may also be formed as a foil from the aforementioned combinations of metallic binder and neutron absorbing phases, and may be deposited on the structural material using the HVLAD method.

Criticality channels or cylindrical shapes may be joined using cold spray at the joint. The coatings of the present disclosure may also be placed on the outside of cylindrical containers.

The present disclosure may involve the use of diode arrays to heat the substrate and coating being deposited thereon, up to the respective softening temperatures, to increase adhesion and bond strength of coating layers. The diode arrays may also be used for annealing and heat-treating the coatings set forth in the present disclosure, thereby relieving stress, and promoting the conversion of precursor coating particles to boron-containing intermetallic compounds (such as TaB2).

Further areas of applicability will become apparent from the description provided herein. The description and specific examples in this summary are intended for purposes of illustration only and are not intended to limit the scope of the present disclosure.

The apparatus, systems, and methods are susceptible to modifications and alternative forms. Specific embodiments are shown by way of example. It is to be understood that the apparatus, systems, and methods are not limited to the particular forms disclosed. The apparatus, systems, and methods cover all modifications, equivalents, and alternatives falling within the spirit and scope of the application as defined by the claims.

BRIEF DESCRIPTION OF THE DRAWINGS

The accompanying drawings, which are incorporated into and constitute a part of the specification, illustrate specific embodiments of the apparatus, systems, and methods and, together with the general description given above, and the detailed description of the specific embodiments, serve to explain the principles of the apparatus, systems, and methods.

FIG. 1 illustrates one embodiment of Applicant's components for a spent nuclear fuel container.

FIG. 2 further illustrates Applicant's components for a spent nuclear fuel container.

DETAILED DESCRIPTION OF SPECIFIC EMBODIMENTS

Figure 3:
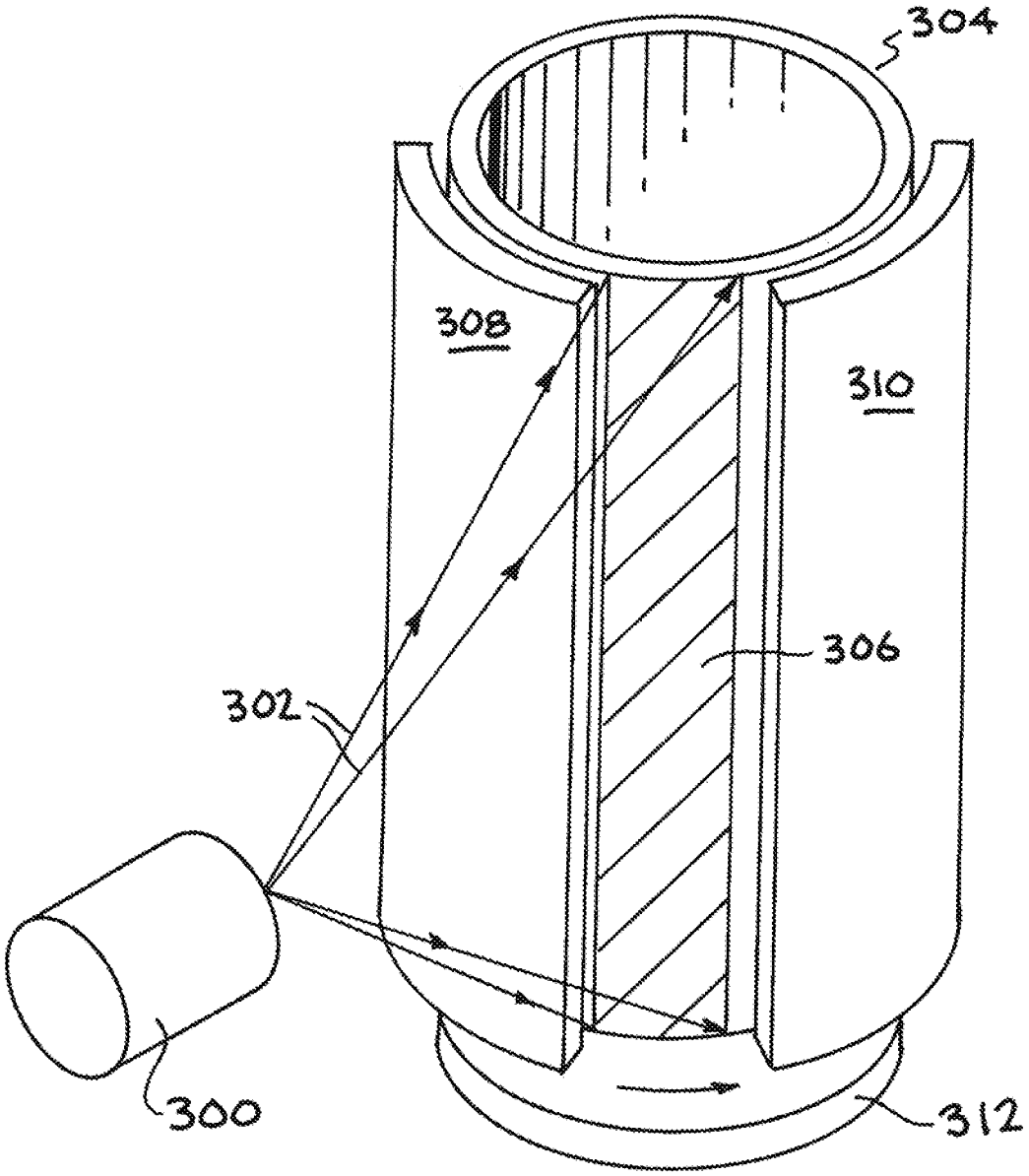
FIG. 3 illustrates another embodiment of Applicant's components for a spent nuclear fuel container.

Referring to the drawings, to the following detailed description, and to incorporated materials, detailed information about the apparatus, systems, and methods is provided including the description of specific embodiments. The detailed description serves to explain the principles of the apparatus, systems, and methods. The apparatus, systems, and methods are susceptible to modifications and alternative forms. The application is not limited to the particular forms disclosed. The application covers all modifications, equivalents, and alternatives falling within the spirit and scope of the apparatus, systems, and methods as defined by the claims.

Example embodiments will now be described more fully with reference to the accompanying drawings.

Containers for the safe storage and/or disposal of spent nuclear fuel from the world's nuclear reactors requires that containers be constructed from strong, corrosion-resistant, and neutron-absorbing materials. The various embodiments and methodologies discussed herein describe new ultra corrosion resistant coatings, some with neutron absorbing properties, that can be used for the construction of such spend nuclear fuel containers. The corrosion resistance of various ones of the coatings, alone, without neutron absorption capability, can be exploited on the outside of the container, while similar materials with the added attribute of high cross-sections for the absorption of thermal neutrons can be used to coat the basket assembly on the inside of the container, which is known in the industry as the "criticality control assembly."

Referring to FIG. 1 there is shown a high level illustration of one embodiment of a portion of a cylindrical spent nuclear fuel (SNF) container 10. The container 10 in this example may have an outer shell portion 12, which in this example is cylindrical, and a basket assembly 14, that each may be constructed using a plurality of different types of corrosion and/or neutron absorbing coatings and/or materials via a plurality of application methods as will be described herein. The basket assembly 14 is constructed so as to fit within the container shell 12 and hold a plurality of spent nuclear fuel rods therein. The container 10, while shown as a cylindrical container, could just as readily be formed as a spherical or prismatic shaped container or vessel, and the teachings described herein will be equally applicable to such other structural shapes. The basket assembly 14 may have perpendicularly arranged rails 16 interconnected to form supports for the spent nuclear fuel rods.

It will be appreciated that while the container 10 described herein is well suited for above-ground storage of spent nuclear fuel, that the coatings, materials and methods of creating same that are discussed in connection with the container 10 may also be used in other applications and on types of structures for containing hazardous radioactive materials. Such applications and/or structures may include, without limitation, coatings for use on the walls of reactor buildings for the purpose of enhance shielding; coatings on the bulkheads and decks of nuclear ships for the purpose of enhanced shielding; coatings or materials for use with shielded tanks and vessels used for the production and reprocessing of nuclear fuels; corrosion-resistant criticality-control assemblies for wet storage of spent nuclear fuel in water-filled pool facilities; and coatings and/or materials used for the fabrication of components such as neutron optics used in neutron radiography facilities.

The container 10 may include an ultra-high corrosion resistant coating 18 applied on its outer surface, and/or possibly on its inner surface as well. Such a coating 18 (or coatings) provide(s) a significantly enhanced degree of corrosion resistance over what would be present with simply a stainless steel or stainless steel/nickel construction for the container.

As shown in FIG. 2, each of the interconnected rails 16 of the basket assembly 14 may have rectangular cross sectional shapes, or possibly even cylindrically circular cross sectional shapes, which act as structural members to support spent nuclear fuel rods. The rails 16 may start out as flat sheets of material before being formed into the desired cross sectional shape(s). The rails 16 may have a coating 20 applied thereto which has excellent anti-corrosion properties as well as neutron absorbing characteristics. It will be understood, however, that the teachings of the present disclosure are not limited to any specific basket assembly or container shell construction.

The materials that can be used as structural material to form either the rails 16 or the shell 12 of the container 10 may include a wide variety of iron-based, nickel-based, aluminum-based and titanium-based materials and alloys. For example, iron-based alloys including but not limited to Type 304 and Type 316 stainless steels; nickel-based alloys including but not limited to the entire range of Ni—Cr—Mo alloys such as Alloy 600, Alloy 625, Alloy 825, Hastelloy C, Hastelloy C-4, Hastelloy C-276, Hastelloy C-22, and others; titanium alloys including but not limited to Ti Grade 2, Ti Grade 7, Ti Grade 12, and others; and various aluminum alloys, including but not limited to aluminum 5083 and others, may be used to form the structural material for the rails 18 and/or the container 10.

Various methods may be employed for the deposition of the above-mentioned corrosion-resistant coating 18 and the anti-corrosion/neutron absorbing coating 20. One such method may involve cold-spray deposition of Ta, Ta-2.5W, or Ta-8W-2Hf, or Ta-10W, each with embedded TaB2 particles for the purpose of neutron absorption. Another method of application may be via a thermal spray of SAM2X5 and SAM1651 iron-based amorphous metal coatings with high concentrations of homogeneously dispersed boron.

Still another method of applying coatings may be via high-velocity, laser-accelerated coatings produced from metallic foil targets containing boron. The boron can be enriched with the B10 isotope to enhance neutron absorption.

The coatings described herein can be produced on flat sheets that can then be bent into rectangular channels for the construction of basket assembly 14 or rolled into cylindrical shapes, such as for use in constructing the container shell 12. Such channels or cylindrical shapes may be joined using cold spray at the joint.

Still another method for applying coatings of various ones of the above-described materials may involve the use of high power diode arrays to heat the substrate and coating being deposited. The diode arrays may be used to heat the substrate and/or the coating up to their respective softening temperatures, to increase adhesion and bond strength of coating layers. The high power diode arrays may be used for annealing and heat-treating coatings, thereby relieving stress and promoting the conversion of precursor coating particles to boron-containing intermetallic compounds (such as TaB2).

In one embodiment tantalum-based materials are also contemplated for use in forming the coatings 18 and 20. Tantalum-based coatings may be applied via a plurality of different methods involving, but not limited to: a thermal spray approach, such as the cold-spray process; a high-velocity oxy fuel (HVOF) process; a high-velocity, laser-accelerated deposition (HVLAD) process; an explosive bonding; an electroplating process; a powder coating process; and virtually any other technique capable of producing a composite coating. In the case of tantalum-based cold-spray and thermal spray coatings, a metallic binder phase may be formed from powders of: unalloyed tantalum (Ta); unalloyed tungsten (W); unalloyed niobium (Nb); tantalum 2.5% tungsten (Ta-2.5W); tantalum 10.0% tungsten (Ta-10W); tantalum 8.0% tungsten 2.0% hafnium (Ta-Ill or Ta-8W-2Hf); special niobium alloys such as Nb-1Zr; special molybdenum alloys such as TZM (Mo-0.5Ti-0.08Zr-0.03C); and others.

In the case where one or both of the coatings 18 and 20 is/are tantalum-based powders applied via a cold-spray or thermal spray process, the neutron absorbing phase of the coating may be formed from a wide plurality of natural and B10-enriched boron-containing materials. The B-10-enriched boron-containing materials may include, without limitation: boron carbide (B4C); tantalum diboride (TaB2); hafnium diboride (HfB2), zirconium diboride (ZrB2), and iron-based boron-containing amorphous metal powders, such as SAM2X5, SAM1651, and other such compositions.

The borides can be formed in situ from a precursor phase containing boron, and co-deposited with the metallic binder phase, through special heat treatments which cause the reaction of the boron and metallic binder phase. In the case where the coatings 18 and/or 20 form amorphous-metal cold-spray and thermal spray coatings, any corrosion-resistant iron-based boron-containing alloy may be used including but not limited to SAM2X1, SAM2X3, SAM2X5, SAM2X7, SAM1651 and others. These same metallic binder and neutron absorbing phases can also be deposited by electrodeposition, electrophoretic deposition, powder coating and other such methods. Foils formed from the aforementioned combinations of metallic binder and neutron absorbing phases may be deposited on the structural material using the HVLAD deposition method.

The foregoing description of the various embodiments sets forth various compositions for the coatings 18 and 20 and has been provided for purposes of illustration and description. The coatings 18 and 20, when applied as a powder via a suitable spray or deposition process, enable a significantly enhanced degree of corrosion resistance to be added to the materials that form the container shell 12 as well as the basket assembly 14. Advantageously, the coatings 18 and 20 do not add appreciable weight the structure and do not necessitate any re-design or modifications to the underlying construction of the container shell 12 or the basket assembly 14. The coatings 18 and 20 may enable a container 10 to be constructed with a significantly greater degree of corrosion resistance as well as an enhanced degree of protection against criticality, with only a modest increase in the cost of manufacture. It will also be appreciated that the coatings 18 and 20 may be used with any type of container, structure, component or device that may be exposed to highly corrosive or otherwise hazardous chemical, biological and/or radioactive substances.

The foregoing description of the various embodiments has been provided merely as an illustration and is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Referring now to FIG. 3, another embodiment of Applicant's components for a spent nuclear fuel container is illustrated. A spray apparatus 300 directs the material 302 onto the vessel being coated 304. The spray pattern is indicated by the crosshatched area 306. A first diode array 308 is positioned to heat the vessel 302. A second diode array 310 is positioned to anneal the vessel 302. A turntable 312 rotates the vessel being coated 304 during the process.

Figure 4:
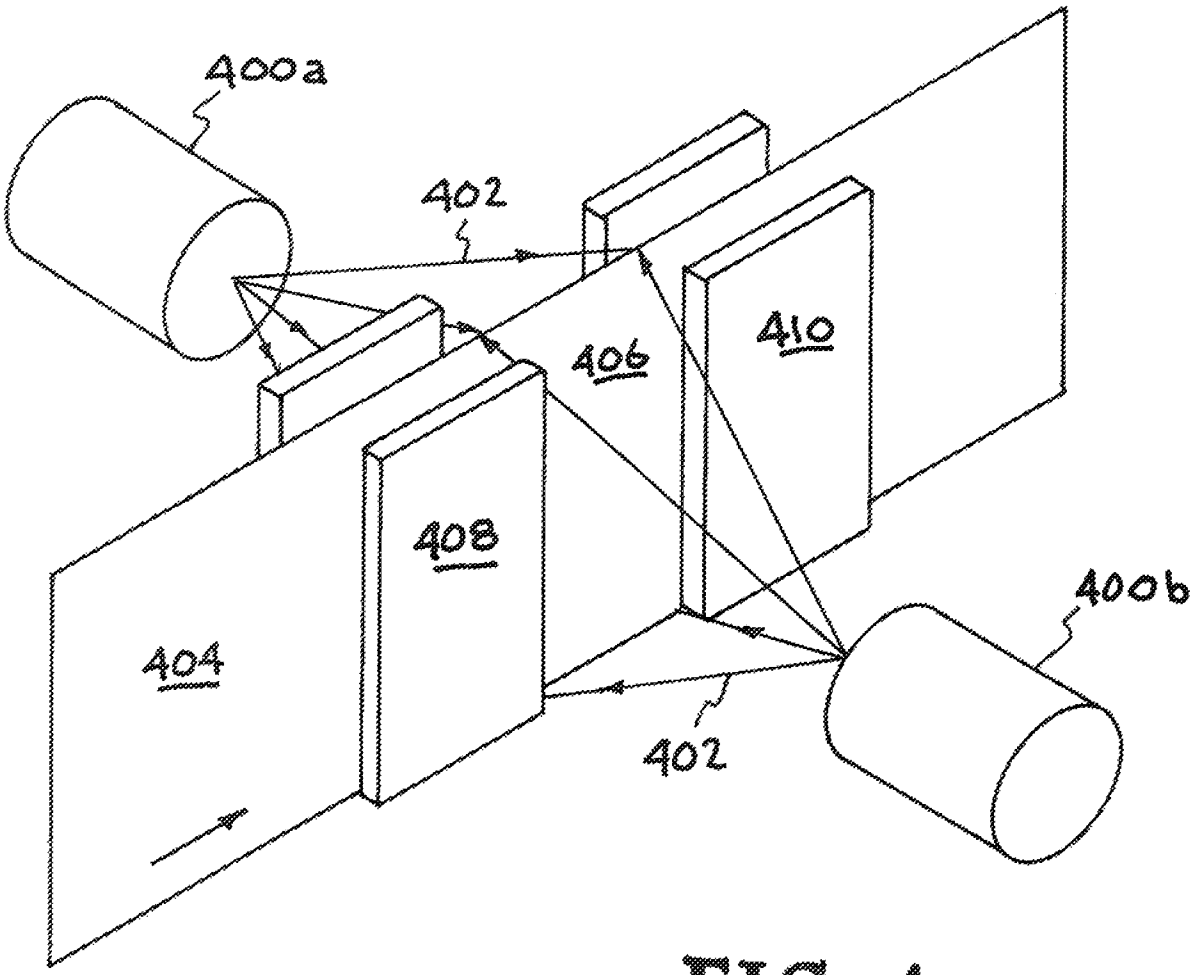
FIG. 4 illustrates another embodiment of Applicant's components for a spent nuclear fuel container.

Referring now to FIG. 4, another embodiment of Applicant's components for a spent nuclear fuel container is illustrated. Spray apparatus 400*a* and 400*b* direct the material 402 onto sheet metal 404 being coated. The spray pattern is indicated by the area 406. A first diode array 408 is positioned to heat the sheet metal 404. A second diode array 410 is positioned to anneal the sheet metal 404.

Figure 5:
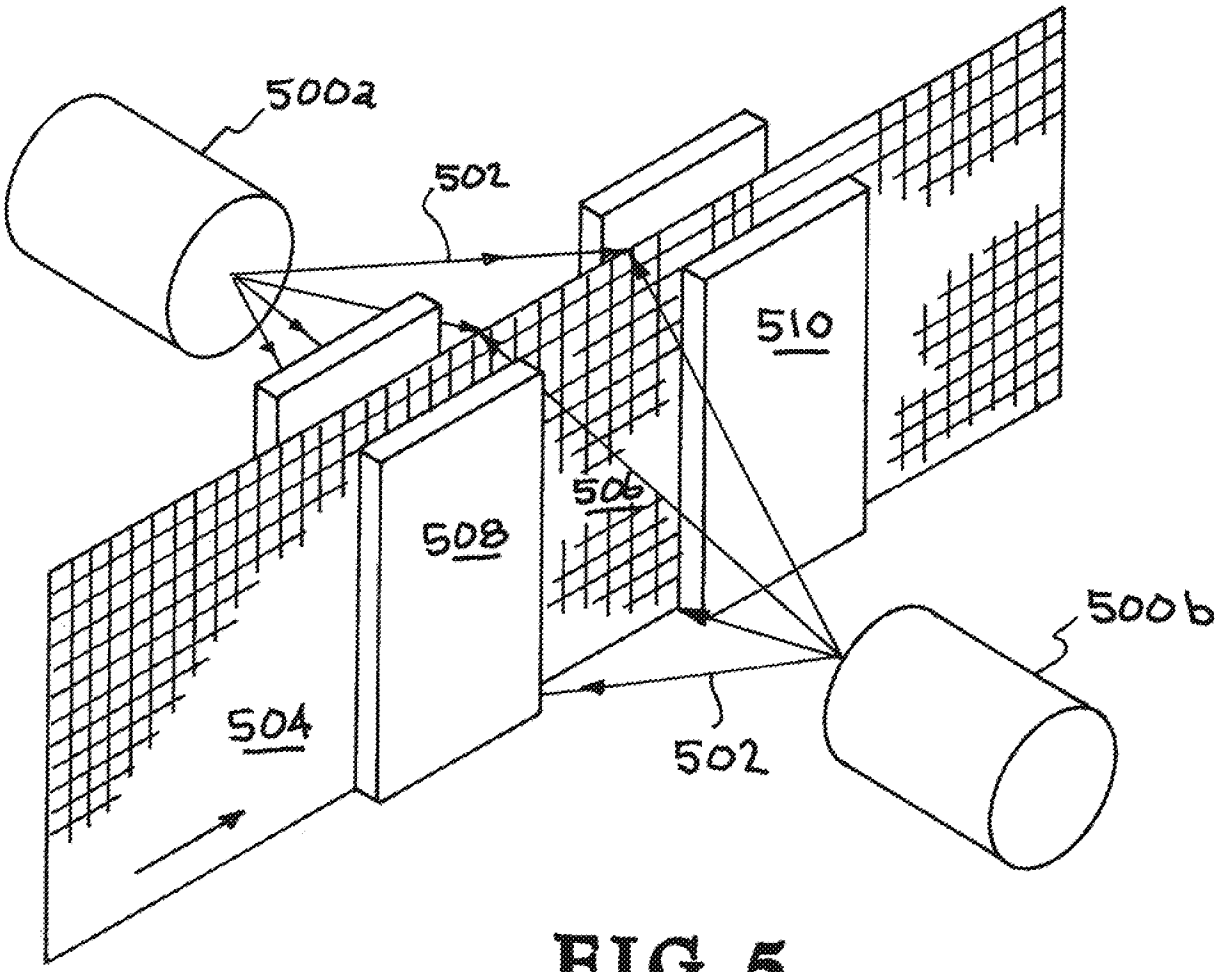
FIG. 5 illustrates another embodiment of Applicant's components for a spent nuclear fuel container.

Referring now to FIG. 5, another embodiment of Applicant's components for a spent nuclear fuel container is illustrated. Spray apparatus 500*a* and 500*b* direct the material 502 onto screen material 504 being coated. The spray pattern is indicated by the area 506. A first diode array 508 is positioned to heat the screen material 504. A second diode array 510 is positioned to anneal the screen material 504.

Figure 6:
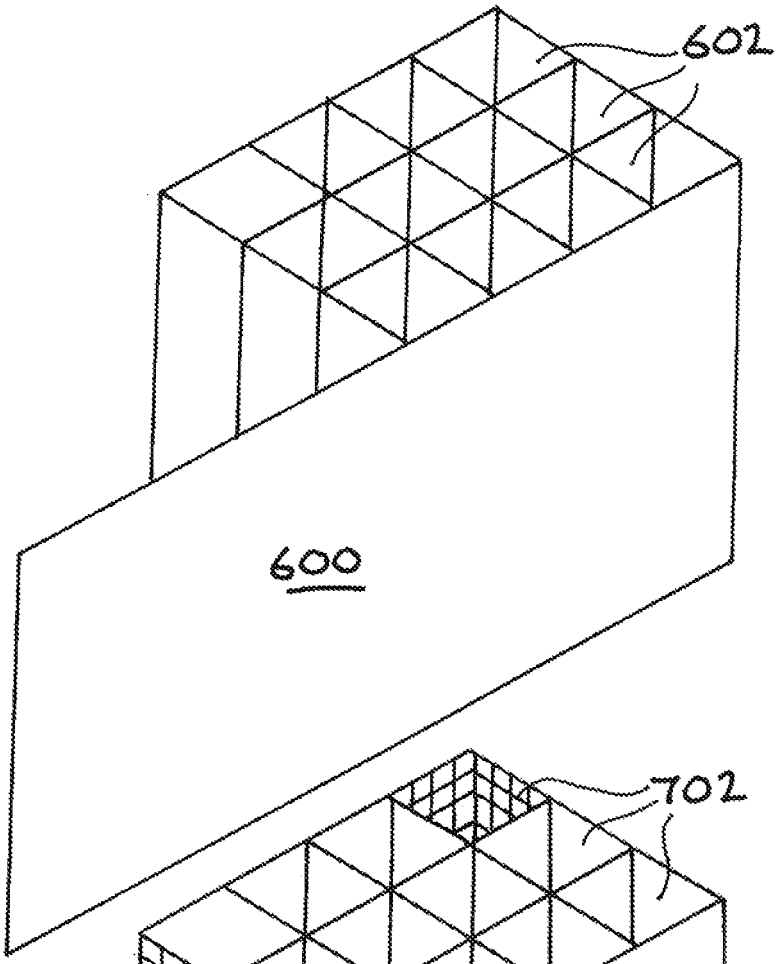
FIG. 6 illustrates another embodiment of Applicant's components for a spent nuclear fuel container.

Referring now to FIG. 6, another embodiment of Applicant's components for a spent nuclear fuel container is illustrated. Sheet metal 600 is folded into container 602 for spent fuel elements.

Figure 7:
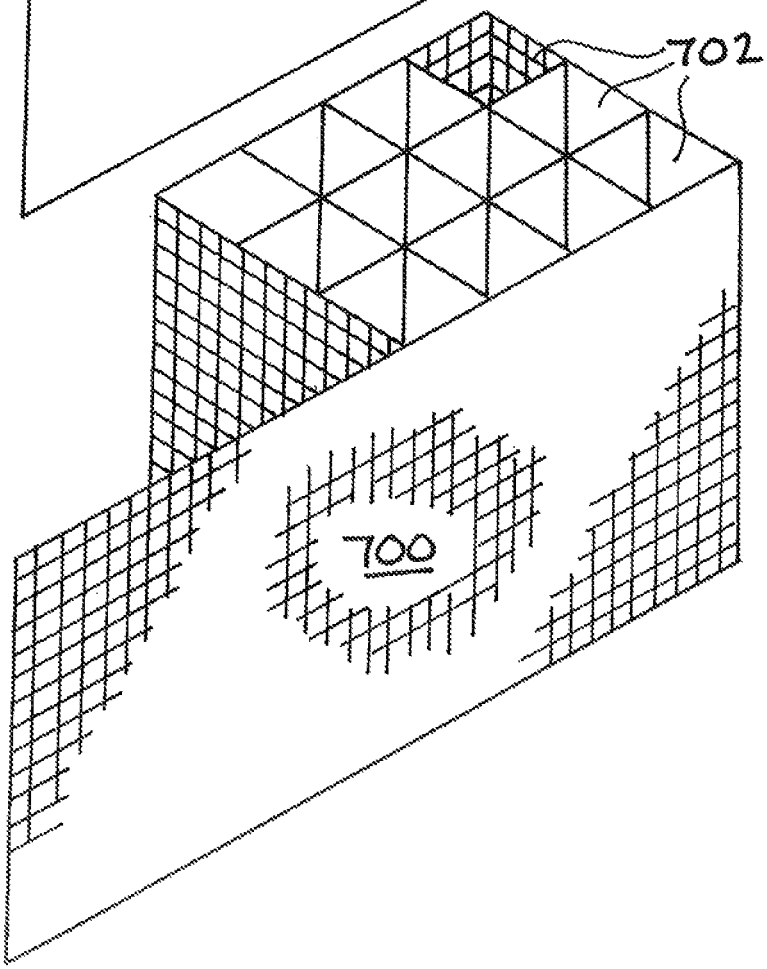
FIG. 7 illustrates another embodiment of Applicant's components for a spent nuclear fuel container.

Referring now to FIG. 7, another embodiment of Applicant's components for a spent nuclear fuel container is illustrated. Screen material 700 is folded into container 702 for spent fuel elements.

Figure 8B:
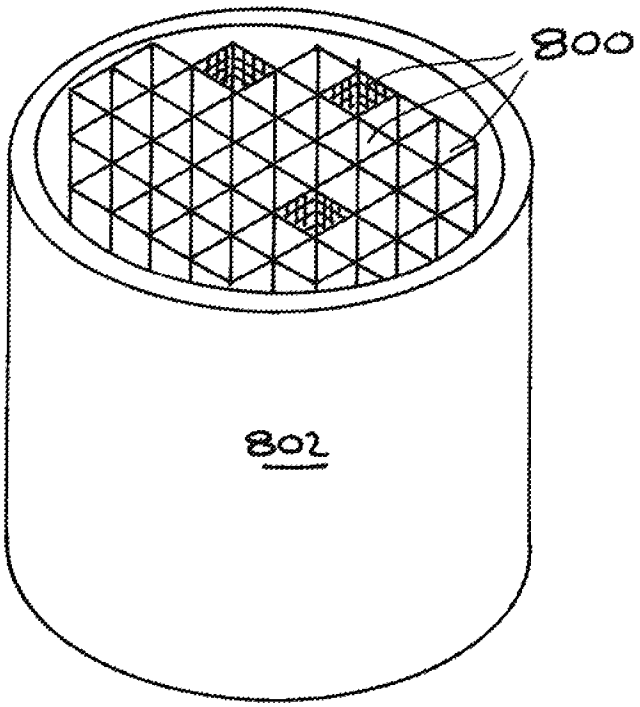
FIGS. 8A and 8B illustrate another embodiment of Applicant's components for a spent nuclear fuel container.
Figure 8A:
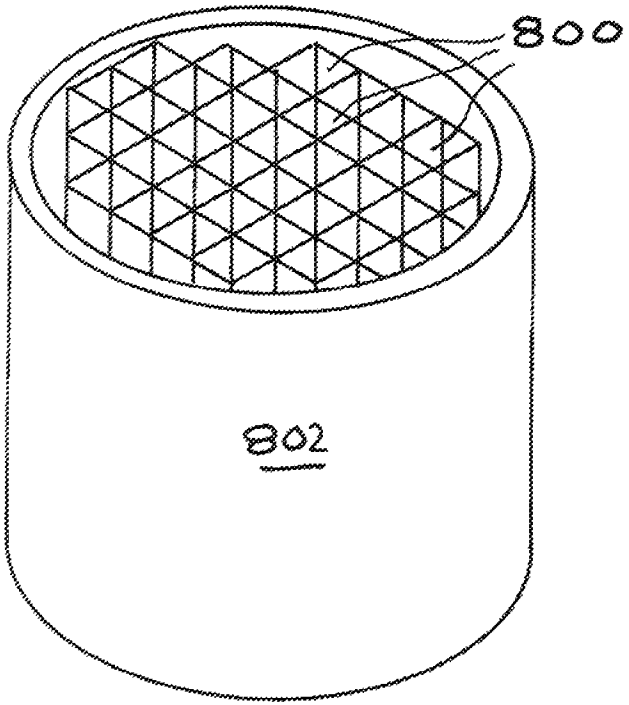

Referring now to FIG. 8A and FIG. 8B, another embodiment of Applicant's components for a spent nuclear fuel container is illustrated. Baskets 800 are located in container 802 for spent fuel elements.

Figure 9A:
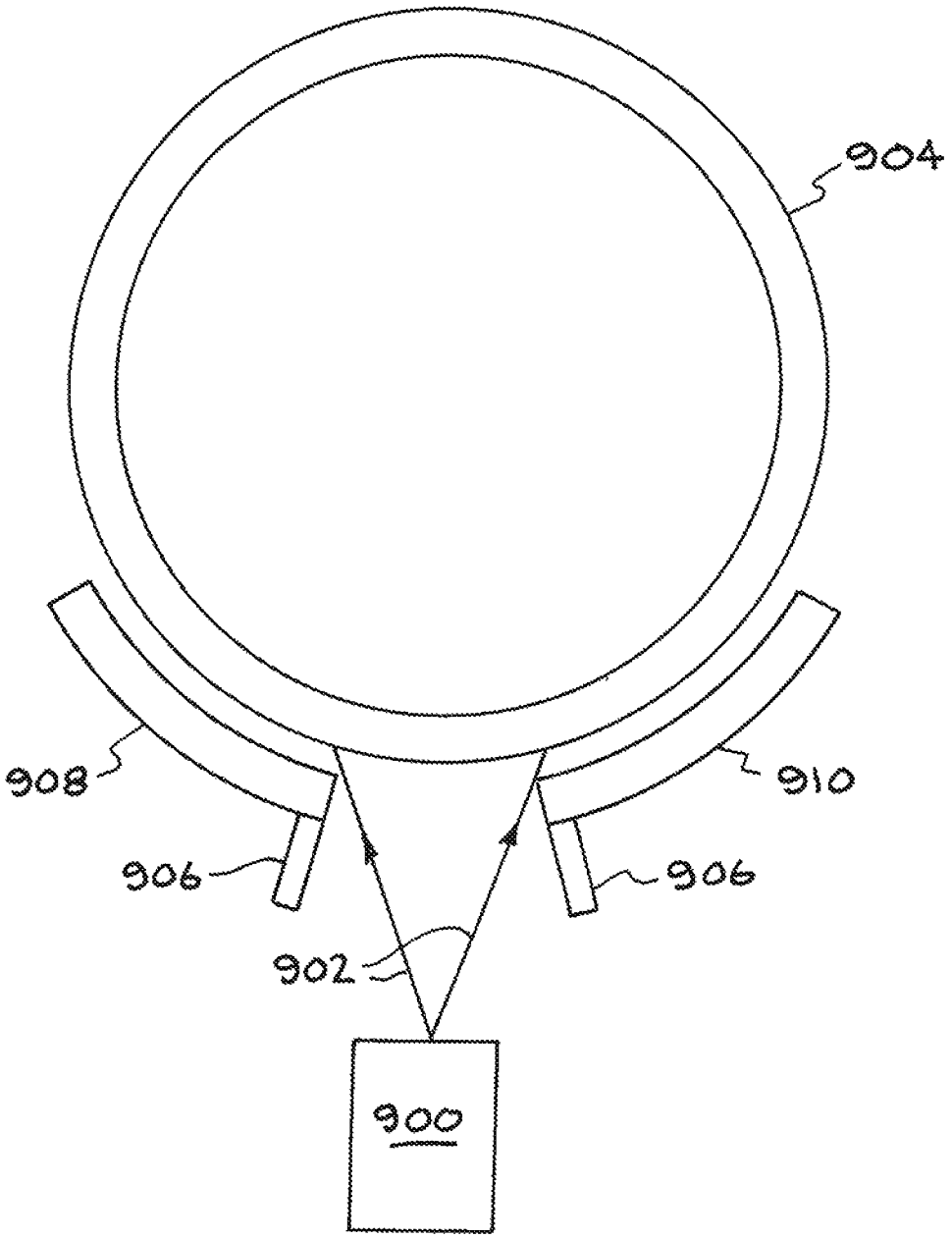
FIGS. 9A and 9B illustrate another embodiment of Applicant's components for a spent nuclear fuel container.
Figure 9B:
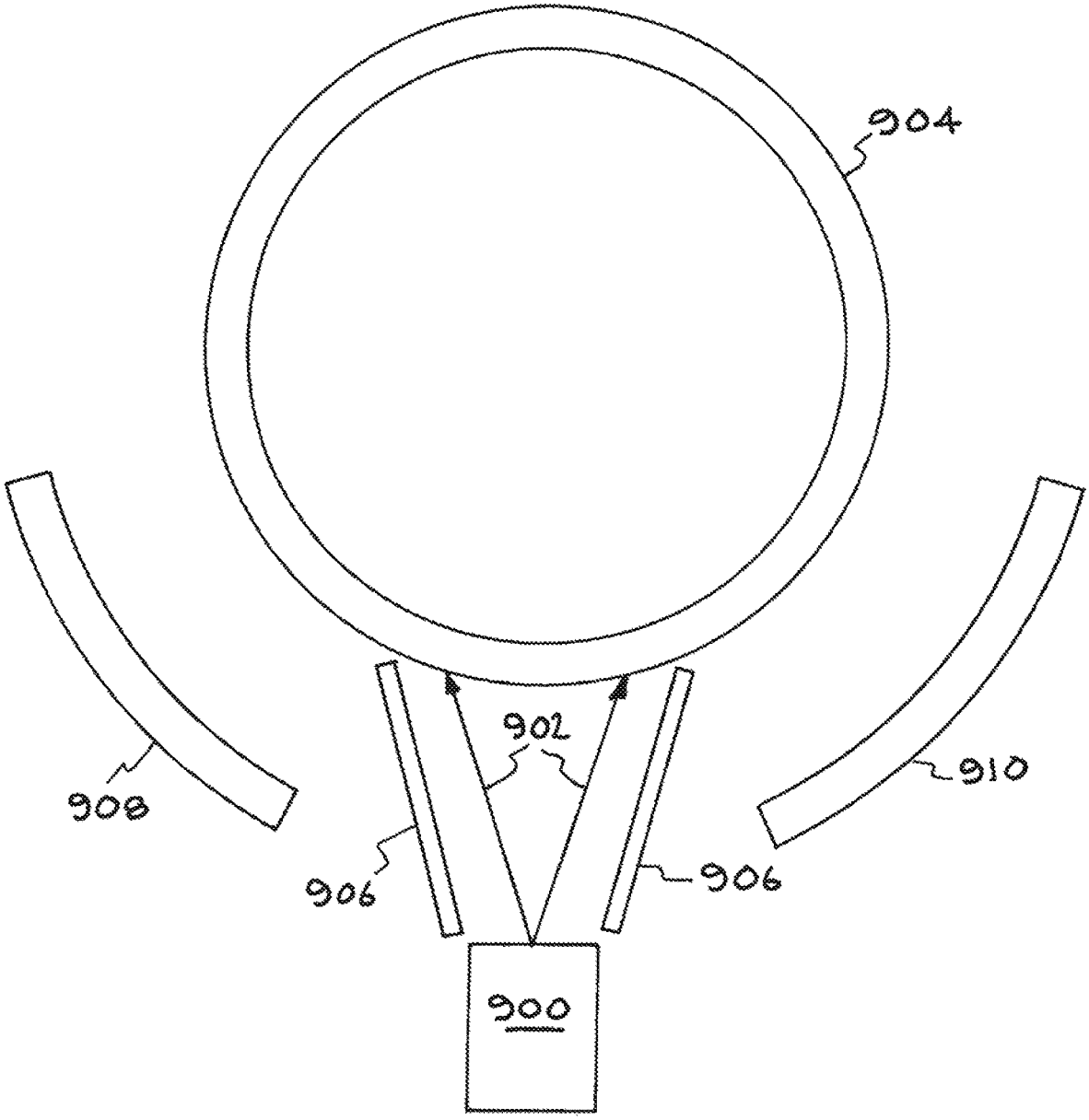

Referring now to FIGS. 9*a* and 9B, another embodiment of Applicant's components for a spent nuclear fuel container is illustrated. A spray apparatus 900 directs the material pray 902 onto the vessel being coated 904. A spray shield 906 controls the spray. A first diode array 908 is positioned to heat the vessel 904. A second diode array 910 is positioned to anneal the vessel 904.

Figure 10:
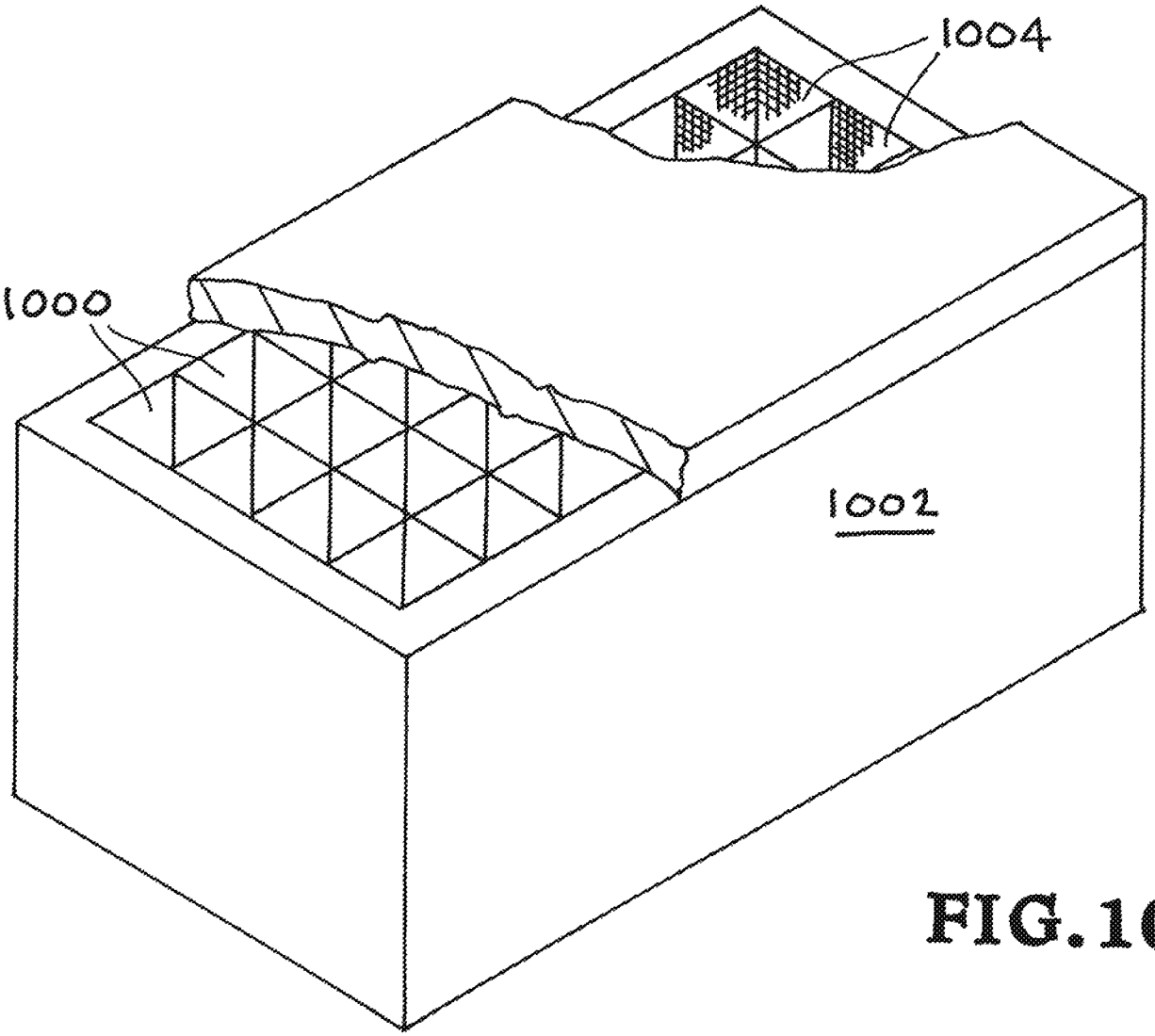
FIG. 10 illustrates another embodiment of Applicant's components for a spent nuclear fuel container.

Referring now to FIG. 10, another embodiment of Applicant's components for a spent nuclear fuel container is illustrated. Sheet metal 1000 is folded into container 1002 for spent fuel elements as illustrated on the left side. Screen material 1004 is folded into container 1002 for spent fuel elements as illustrated on the right side.

Figure 11:
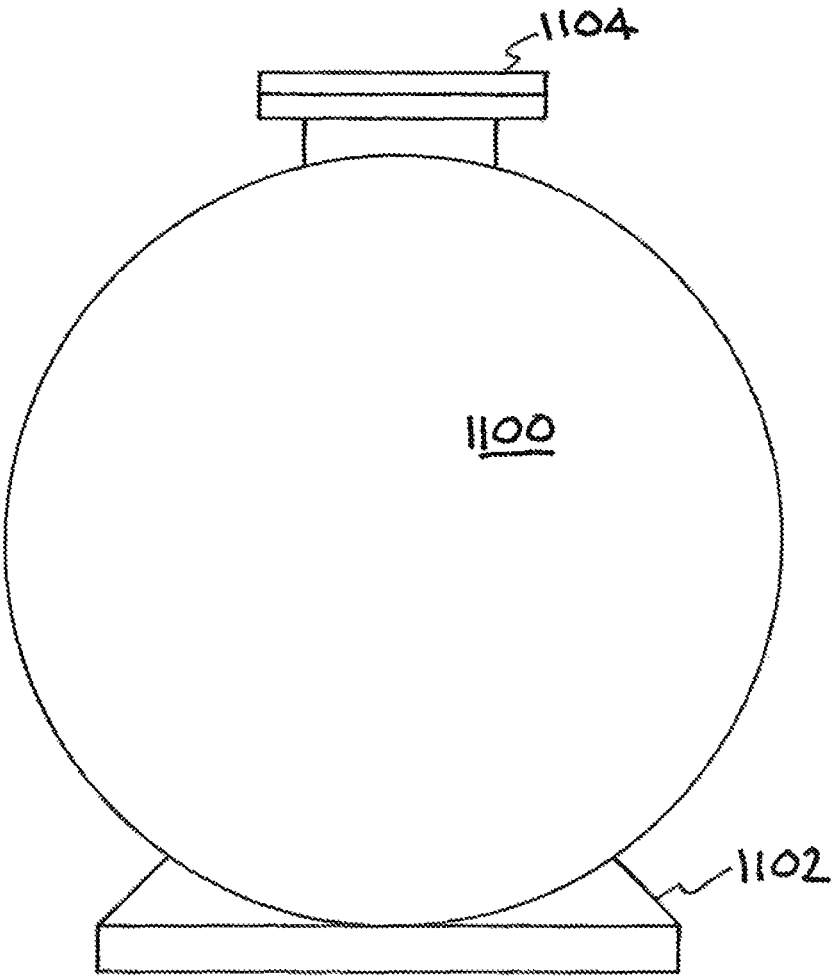
FIG. 11 illustrates another embodiment of Applicant's components for a spent nuclear fuel container.

Referring now to FIG. 11, another embodiment of Applicant's components for a spent nuclear fuel container is illustrated. A vessel 1100 is shown for storing spent nuclear fuel in pellet form. The vessel 1100 is positioned on a base 1102 and includes an access port 1004.

Figure 12:
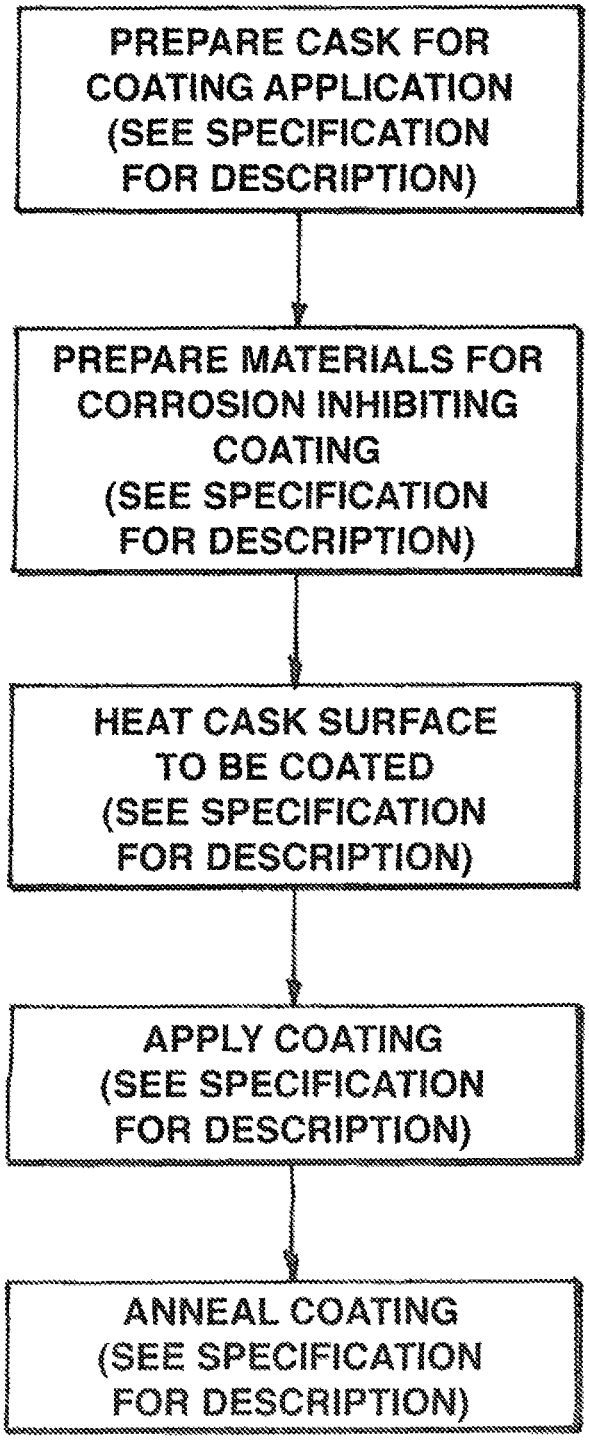
FIG. 12 is a flow chart illustrating an embodiment of Applicant's components for a spent nuclear fuel container.

Referring now to FIG. 12, another embodiment of Applicant's components for a spent nuclear fuel container is illustrated. A flow chart illustrates the steps for coating a spent nuclear fuel container.

Figure 13:
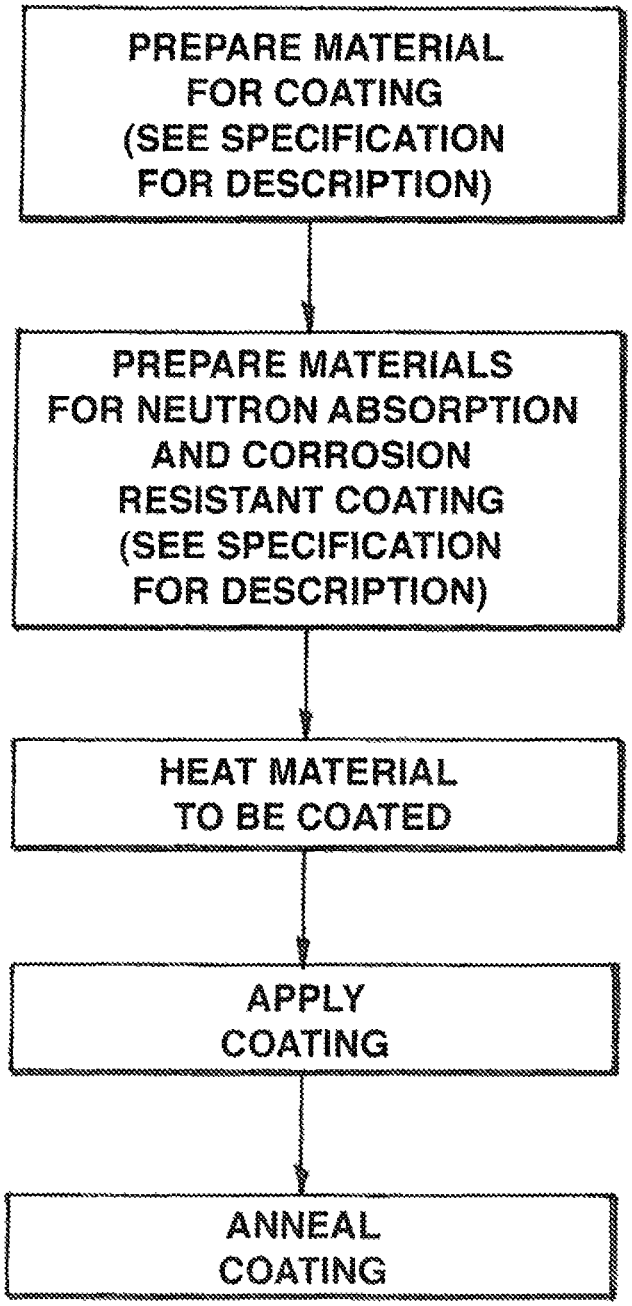
FIG. 13 is a flow chart illustrating another embodiment of Applicant's components for a spent nuclear fuel container.

Referring now to FIG. 13, another embodiment of Applicant's components for a spent nuclear fuel container is illustrated. A flow chart illustrates the steps for coating a spent nuclear fuel container.

Applicant's components for a spent nuclear fuel container and method of fabricating components for a spent nuclear fuel container include many other embodiments. The apparatus, systems, and methods include the following:

1. Use of coated cylindrical and rectangular channels as the structural members of criticality control assemblies.

2. The coating of channels with corrosion-resistant neutron-absorbing materials either before or after forming flat plates into cylindrical and rectangular channels. Flat plates can be coated, and then bent or rolled into the structural members of criticality control assemblies.

3. The use of either thermal or cold spray technology to deposit such coatings on channel materials serving as structural members.

4. The materials that can be used as structural material include a wide variety of iron-based, nickel-based, aluminum-based and titanium-based materials and alloys. For example, iron-based alloys include but are not limited to Type 304 and Type 316 stainless steels; nickel-based alloys including but not limited to the entire range of Ni—Cr—Mo alloys, such as Alloy 600, Alloy 625, Alloy 825, Hastelloy C, Hastelloy C-4, Hastelloy C-276, Hastelloy C-22, and others; titanium alloys including but not limited to Ti Grade 2, Ti Grade 7, Ti Grade 12, and others; and various aluminum alloys, including but not limited to aluminum 5083 and others.

5. The use of tantalum-based materials for coating the structural members, using either a thermal spray approach, such as the cold-spray process; the high-velocity oxy fuel (HVOF) process; the high-velocity laser-accelerated deposition (HVLAD) process; explosive bonding; electroplating; powder coating; and any other technique capable of producing a composite coating.

6. In the case of tantalum-based cold-spray and thermal spray coatings, a metallic binder phase will be formed from powders of: unalloyed tantalum (Ta); unalloyed tungsten (W); unalloyed niobium (Nb); tantalum 2.5% tungsten (Ta-2.5W); tantalum 10.0% tungsten (Ta-10W); tantalum 8.0% tungsten 2.0% hafnium (Ta-1 or Ta-8W-2Hf); special niobium alloys such as Nb-1Zr; special molybdenum alloys such as TZM (Mo-0.5Ti-0.08Zr-0.03C); and others.

7. In the case of the tantalum-based cold-spray and thermal spray coatings, the neutron absorbing phase will be formed from a wide variety of natural and B10-enriched boron-containing materials, including but not limited to: boron carbide (B4C); tantalum diboride (TaB2); hafnium diboride (HfB2), zirconium diboride (ZrB2), and iron-based boron-containing amorphous metal powders, such as SAM2X5, SAM1651, and other such compositions.

8. The borides can be formed in situ from a precursor phase containing boron, and co-deposited with the metallic binder phase, through special heat treatments which cause the reaction of the boron and metallic binder phase.

9. In the case of amorphous-metal cold-spray and thermal spray coatings, any corrosion-resistant iron-based boron-containing alloy can be used, including but not limited to SAM2X1, SAM2X3, SAM2X5, SAM2X7, SAM1651, and others.

10. These same metallic binder and neutron absorbing phases can also be deposited by electrodeposition, electrophoretic deposition, powder coating, and other such methods.

11. Foils formed from the aforementioned combinations of metallic binder and neutron absorbing phases can be deposited on the structural material using the HVLAD method.

The apparatus, systems, and methods include the following pertaining to corrosion-resistant criticality control assemblies:

1. The coating of cylindrical, spherical or prismatic shaped vessels for the storage of spent nuclear fuel with corrosion-resistant materials.

2. The use of either thermal or cold spray technology to deposit such coatings on channel materials serving as structural members.

3. The materials that can be used as structural material include a wide variety of iron-based, nickel-based, aluminum-based and titanium-based materials and alloys. For example, iron-based alloys include but are not limited to Type 304 and Type 316 stainless steels; nickel-based alloys including but not limited to the entire range of Ni—Cr—Mo alloys, such as Alloy 600, Alloy 625, Alloy 825, Hastelloy C, Hastelloy C-4, Hastelloy C-276, Hastelloy C-22, and others; titanium alloys including but not limited to Ti Grade 2, Ti Grade 7, Ti Grade 12, and others; and various aluminum alloys, including but not limited to aluminum 5083 and others.

4. The use of tantalum-based materials for coating the structural members, using either a thermal spray approach, such as the cold-spray process; the high-velocity oxy fuel (HVOF) process; the high-velocity laser-accelerated deposition (HVLAD) process; explosive bonding; electroplating; powder coating; and any other technique capable of producing a composite coating.

5. In the case of tantalum-based cold-spray and thermal spray coatings, a metallic binder phase will be formed from powders of: unalloyed tantalum (Ta); unalloyed tungsten (W); unalloyed niobium (Nb); tantalum 2.5% tungsten (Ta-2.5W); tantalum 10.0% tungsten (Ta-10W); tantalum 8.0% tungsten 2.0% hafnium (Ta-111 or Ta-8W-2Hf); special niobium alloys such as Nb-1Zr; special molybdenum alloys such as TZM (Mo-0.5Ti-0.08Zr-0.03C); and others.

6. In the case of the tantalum-based cold-spray and thermal spray coatings, the neutron absorbing phase will be formed from a wide variety of natural and B10-enriched boron-containing materials, including but not limited to: boron carbide (B4C); tantalum diboride (TaB2); hafnium diboride (HfB2), zirconium diboride (ZrB2), and iron-based boron-containing amorphous metal powders, such as SAM2X5, SAM1651, and other such compositions.

7. The borides can be formed in situ from a precursor phase containing boron, and co-deposited with the metallic binder phase, through special heat treatments which cause the reaction of the boron and metallic binder phase.

8. In the case of amorphous-metal cold-spray and thermal spray coatings, any corrosion-resistant iron-based boron-containing alloy can be used, including but not limited to SAM2X1, SAM2X3, SAM2X5, SAM2X7, SAM1651, and others.

9. These same metallic binder and neutron absorbing phases can also be deposited by electrodeposition, electrophoretic deposition, powder coating, and other such methods.

10. Foils formed from the aforementioned combinations of metallic binder and neutron absorbing phases can be deposited on the structural material using the HVLAD method.

11. Criticality channels or cylindrical shapes can be joined using cold spray at the joint. Such coatings can also be placed on the outside of cylindrical containers.

12. Diode arrays can be used to heat the substrate and coating being deposited, up to the respective softening temperatures, to increase adhesion and bond strength of coating layers. We also claim that diode arrays can be used for annealing and heat-treating coatings, thereby relieving stress, and promoting the conversion of precursor coating particles to boron-containing intermetallic compounds (such as TaB2).

Although the description above contains many details and specifics, these should not be construed as limiting the scope of the application but as merely providing illustrations of some of the presently preferred embodiments of the apparatus, systems, and methods. Other implementations, enhancements and variations can be made based on what is described and illustrated in this patent document. The features of the embodiments described herein may be combined in all possible combinations of methods, apparatus, modules, systems, and computer program products. Certain features that are described in this patent document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination. Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described above should not be understood as requiring such separation in all embodiments.

Therefore, it will be appreciated that the scope of the present application fully encompasses other embodiments which may become obvious to those skilled in the art. In the claims, reference to an element in the singular is not intended to mean "one and only one" unless explicitly so stated, but rather "one or more." All structural and functional equivalents to the elements of the above-described preferred embodiment that are known to those of ordinary skill in the art are expressly incorporated herein by reference and are intended to be encompassed by the present claims. Moreover, it is not necessary for a device to address each and every problem sought to be solved by the present apparatus, systems, and methods, for it to be encompassed by the present claims. Furthermore, no element or component in the present disclosure is intended to be dedicated to the public regardless of whether the element or component is explicitly recited in the claims. No claim element herein is to be construed under the provisions of 35 U.S.C. 112, sixth paragraph, unless the element is expressly recited using the phrase "means for."

While the apparatus, systems, and methods may be susceptible to various modifications and alternative forms, specific embodiments have been shown by way of example in the drawings and have been described in detail herein. However, it should be understood that the application is not intended to be limited to the particular forms disclosed. Rather, the application is to cover all modifications, equivalents, and alternatives falling within the spirit and scope of the application as defined by the following appended claims.

The invention claimed is:

1. A method of fabricating structural components and producing a spent nuclear fuel container and: forming a multiplicity of rectangular channels to produce a structural component for the spent nuclear fuel container, comprising the steps of:

providing a single piece of sheet metal wherein said single piece of sheet metal has a front and a back, providing a front spray apparatus positioned proximate said front of said single piece of sheet metal that produces a spray pattern on said front of said single piece of sheet metal, providing a back spray apparatus positioned proximate said back of said single piece of sheet metal that produces a spray on said back of said single piece of sheet metal, applying a coating that includes tantalum-based material and enriched boron material to said front and to said back of said single piece of sheet metal using said front spray apparatus and said back spray apparatus, providing a front heating diode array positioned proximate said front of said single piece of sheet metal wherein said front heating diode array is offset from said spray pattern on said front of said single piece of sheet metal, providing a back heating diode array positioned proximate said back of said single niece of sheet metal, heating said single piece of sheet metal using said front diode array and said back heating diode array to heat said front and said back of said single piece of sheet metal, providing a front annealing diode array positioned proximate said front of said single piece of sheet metal wherein said front annealing diode array is offset from said spray pattern on said front of said single piece of sheet metal, providing a back annealing diode array positioned proximate said back of said single niece of sheet metal, annealing said single piece of sheet metal using said front annealing diode array and said back annealing diode array to anneal said front and said back of said single piece of sheet metal, and folding said single piece of sheet metal to form said multiplicity of rectangular channels, and performing the additional step of positioning said multiplicity of rectangular channels in a cylindrical container to form the spent nuclear fuel container.

2. The method of fabricating structural components and producing a spent nuclear fuel container of claim 1 wherein said enriched boron material is tantalum diboride (TaB2).

3. The method of fabricating structural components and producing a spent nuclear fuel container of claim 1 wherein said step of forming a multiplicity of rectangular channels comprises forming using said single piece of sheet metal that has a front and a back wherein said single piece of sheet metal is folded into said multiplicity of rectangular channels.

4. The method of fabricating structural components and producing a spent nuclear fuel container of claim 1 wherein said step of applying a coating that includes tantalum-based material and enriched boron material comprises using a front thermal spraying apparatus and a back thermal spraying apparatus.

5. The method of fabricating structural components and producing a spent nuclear fuel container of claim 1 wherein said step of applying a coating that includes tantalum-based material and enriched boron material comprises using a front cold spraying apparatus and a back cold spraying apparatus.

6. The method of fabricating structural components and producing a spent nuclear fuel container of claim 1 wherein said step of applying a coating that includes tantalum-based material and enriched boron material comprises using a front high-velocity oxy fuel spraying apparatus and a back high-velocity oxy fuel spraying apparatus.

7. The method of fabricating structural components and producing a spent nuclear fuel container of claim 1 wherein said step of applying a coating that includes tantalum-based material and enriched boron material comprises using a front high-velocity laser-accelerated deposition spraying apparatus and a back high-velocity laser-accelerated deposition spraying apparatus.

8. A method of fabricating structural components and producing a spent nuclear fuel container comprising the steps of:

providing a cylindrical vessel, providing a spray apparatus positioned proximate said cylindrical vessel that produces a material spray onto said cylindrical vessel, applying a coating that includes tantalum-based material and enriched boron material to said cylindrical vessel using said spray apparatus that sprays said tantalum-based material and enriched boron material in said material spray onto said cylindrical vessel, providing a first spray shield, providing a second spray shield, positioning said first spray shield and said second spray shield proximate said material spray wherein said first spray shield and said second spray shield and said material spray are between said material spray apparatus and said cylindrical vessel, providing a first diode array positioned proximate the cylindrical vessel away from said material spray, using said first diode array to heat said cylindrical vessel, providing a second diode array Positioned proximate the cylindrical vessel away from said material spray, using said second diode array to anneal said cylindrical vessel, providing a single piece of sheet metal wherein said single piece of sheet metal has a front and a back, providing a front spray apparatus positioned proximate said front of said single niece of sheet metal that produces a spray pattern on said front of said single piece of sheet metal, providing a back spray apparatus positioned proximate said back of said single piece of sheet metal that produces a spray on said back of said single piece of sheet metal, applying a coating that includes tantalum-based material and enriched boron material to said front and to said back of said single piece of sheet metal using said front spray apparatus and said back spray apparatus, providing a front heating diode array positioned proximate said front of said single piece of sheet metal, providing a back heating diode array positioned proximate said back of said single piece of sheet metal, heating said single piece of sheet metal using said front heating diode array and said back heating diode array to heat said front and said back of said single piece of sheet metal, providing a front annealing diode array positioned proximate said front of said single niece of sheet metal, providing a back annealing diode array positioned proximate said back of said single piece of sheet metal, annealing said single piece of sheet metal using said front annealing diode array and said back annealing diode array to anneal said front and said back of said single piece of sheet metal, folding said single piece of sheet metal to form a multiplicity of rectangular channels, and positioning said multiplicity of rectangular channels in said cylindrical vessel to form the spent nuclear fuel vessel.

* * * * *